US007681367B2

(12) United States Patent
Morton et al.

(10) Patent No.: US 7,681,367 B2
(45) Date of Patent: Mar. 23, 2010

(54) WALL REINFORCEMENT USING CONSTANT FORCE

(75) Inventors: Steven E. Morton, Pickerington, OH (US); Robert R. Thompson, Columbus, OH (US)

(73) Assignee: Nationwide Reinforcing, Ltd., Columbus, OH (US)

( * ) Notice: Subject to any disclaimer, the term of this patent is extended or adjusted under 35 U.S.C. 154(b) by 862 days.

(21) Appl. No.: 11/392,431

(22) Filed: Mar. 29, 2006

(65) Prior Publication Data

US 2007/0227082 A1 Oct. 4, 2007

(51) Int. Cl.
*E04G 23/00* (2006.01)
*E04B 2/82* (2006.01)
*E02D 37/00* (2006.01)

(52) U.S. Cl. ..... 52/291; 52/514; 52/126.3; 248/354.3

(58) Field of Classification Search ..... 52/127.2, 52/126.3, 514, 169.1, 291, 223.13, 223.14, 52/573.1, 293.3; 405/258.1, 259.1, 262, 405/284, 302.1, 302.2; 248/354.3
See application file for complete search history.

(56) References Cited

U.S. PATENT DOCUMENTS 587,274 A * 7/1897 Rue ..... 254/101
3,295,280 A * 1/1967 Kettner ..... 52/378
3,690,084 A * 9/1972 Leblanc ..... 52/514
3,936,988 A * 2/1976 Miceli ..... 52/514
4,408,429 A * 10/1983 Neal ..... 52/514
4,513,939 A * 4/1985 Berger et al. ..... 248/544
4,893,784 A * 1/1990 Abraham et al. ..... 254/100
5,180,268 A * 1/1993 Richardson ..... 411/536
5,535,561 A * 7/1996 Schuyler ..... 52/223.13
5,568,711 A * 10/1996 Popp et al. ..... 52/704
5,845,450 A * 12/1998 Larsen ..... 52/574
6,044,613 A * 4/2000 Crafts et al. ..... 52/741.1
6,195,949 B1 * 3/2001 Schuyler ..... 52/223.13
6,357,190 B1 * 3/2002 Florentine ..... 52/293.2
6,662,505 B2 * 12/2003 Heady et al. ..... 52/127.2
6,904,728 B2 * 6/2005 Stutts ..... 52/233
2003/0089050 A1 * 5/2003 Tipping et al. ..... 52/127.2
2005/0204673 A1 * 9/2005 Reed ..... 52/514
2006/0137278 A1 * 6/2006 Heady et al. ..... 52/514

* cited by examiner

*Primary Examiner*—R. Chilcot
*Assistant Examiner*—Babajide Demuren
(74) *Attorney, Agent, or Firm*—Jason H. Foster; Kremblas Foster Intellectual Property

(57) ABSTRACT

A wall support and reinforcing apparatus that applies a constant force on a structural support member, such as a steel I-beam, that is adjacent the wall. The apparatus includes a bias that is interposed between the building, or a bracket mounted to the building, and the structural member. Thus, the bias force is applied to straighten the wall at all times, thereby having the straightening effect and keeping the structural member from being displaced laterally due to complete release of all forces to the structural member.

2 Claims, 10 Drawing Sheets

WALL REINFORCEMENT USING CONSTANT FORCE

BACKGROUND OF THE INVENTION

1. Field of the Invention

This invention relates generally to the field of wall reinforcements, and relates more particularly to the field of structural members for reinforcing inwardly bowed or otherwise damaged subterranean walls with damage that can vary seasonally or throughout the period of reinforcement.

2. Description of the Related Art

It is known in the field of construction and repair of homes and other buildings that basement walls are typically made of concrete. The concrete can be poured as solid walls, or individual concrete blocks can be stacked, with mortar placed therebetween, to form a wall. Concrete block walls are commonly hollow, but can be filled with concrete and reinforcing rods of metal or other material in order to strengthen the walls and make them less susceptible to the infiltration of water through the walls.

Concrete walls of all types are extremely strong in compression, and have disproportionate weakness in tension. This causes concrete walls subjected to substantial tensile forces to fracture. A common source of tensile force in basement walls is a horizontally-directed inward force applied to the walls by the soil that is backfilled against the subterranean walls. This bending force on the walls creates a tensile force on the inside of the wall, and causes walls to crack once the force becomes substantial enough. Additionally, such inwardly directed forces can move rows of blocks, or the entire wall, inward in shear from the foundation rather than causing bowing. Obviously, this has a deleterious effect on the structural integrity of the building, and can cause water infiltration.

Reduction in horizontal forces can alleviate the bowing of basement walls, and this can be accomplished by reducing water flow into the soil surrounding the building and other methods. Additionally, or alternatively, the walls themselves can be strengthened in order to alleviate the bowing. Historically, the strengthening of subterranean walls has been accomplished by placing a structural member against the interior surface and bracing that member against other structural members of the building, such as the concrete floor at the base of the bowed wall, and the floor joists at the top of the bowed wall. This can be carried out using simple fasteners, or more complex jacks.

U.S. Pat. No. 6,662,505 to Heady et al., which is incorporated herein by reference, discloses an apparatus for applying a horizontal force at the top of a structural member, such as a steel I-beam. The beam is mounted to the basement floor at its base, and the top is mounted in the apparatus of Heady. Upon the application of force to the top of the beam by screwing in the threaded bolt of Heady's device, the beam is forced against the bowed wall, and exerts a force to the wall that opposes the bowing force.

One disadvantage of the Heady patent and other conventional wall reinforcement methods of which the inventors are aware is that they do not supply a force against the wall that remains if the soil contracts and the wall moves outward toward the soil. For example, in most regions of the world, subterranean forces against walls vary throughout the year, due to seasonal changes in moisture content or temperatures, or due to other variations that occur over time. As these forces vary, the wall can move away from a beam supporting the wall. Thus, conventional wall reinforcement apparatuses apply a force to the wall when the apparatus is first installed, but do not continue to apply a force if there is movement of the wall away from the supporting beam unless the apparatus is manually tightened. In extreme cases in which a bowed wall is straightened substantially, the beam can be unsupported enough to fall over. In this case, anyone nearby could be injured by heavy steel structures striking them. Likewise, property could be damaged by the heavy beams. The only alternative in the prior art is to check the force on the beam frequently and manually tighten the screw that applies the force.

Therefore, there is a need for an invention that applies a force to the wall in any situation, or at least retains the structural beam if the inwardly-directed force relaxes enough to permit the beam to move under its own weight.

BRIEF SUMMARY OF THE INVENTION

The invention is an apparatus for supporting a wall in a building. A structural member, which can be a steel I-beam, C-channel, plate or any other such member, is seated against the wall. The structural member has a lower end that can be mounted at a floor that intersects the wall. The structural member extends upwardly away from the floor to an upper end. The apparatus comprises a bracket rigidly anchored adjacent the building and spaced from the structural member. A bias, such as a spring, is interposed between the bracket and the structural member. The bias exerts oppositely-directed forces against the bracket and the structural member, and one of the forces has a component directed toward the wall in order to force the structural member toward the wall and support the wall. Of course, any other bias device can be used that applies a continuous force, including without limitation a gas spring and an electrical device.

In a preferred embodiment, the upper end of the beam is adjacent the bracket, which is mounted to the building, and a force-applying device, such as a bolt extending through the bracket, applies a force to the structural member, and has one end seating against the structural member. The bias in the preferred embodiment is a coil spring, and the bolt extends from the bracket with the spring encircling at least a portion of the bolt.

The invention also contemplates a method of using the structural member to support a wall in a building. The method comprises seating the structural member against the wall and mounting the lower end of the structural member at the floor that intersects the wall. A bracket is secured to the building spaced from the upper end of the structural member, and a bias is interposed between the bracket and the structural member. The bias exerts oppositely-directed forces against the bracket and the structural member, and one of the forces has a component directed toward the wall for supporting the wall.

In a preferred method, a force-applying device, such as a bolt extending from the bracket, applies a force to the structural member, and the step of interposing a bias further comprises extending a coil spring from the bracket to the structural member around at least a portion of the bolt.

In a most preferred embodiment, the step of pre-compressing the spring is added before interposing the spring between the bracket and the structural member, and this is accomplished using a screw extended through the bracket and through the spring. Additionally, the method includes removing the screw to uncompress the spring, and inserting the bolt through the bracket.

Figure 1:
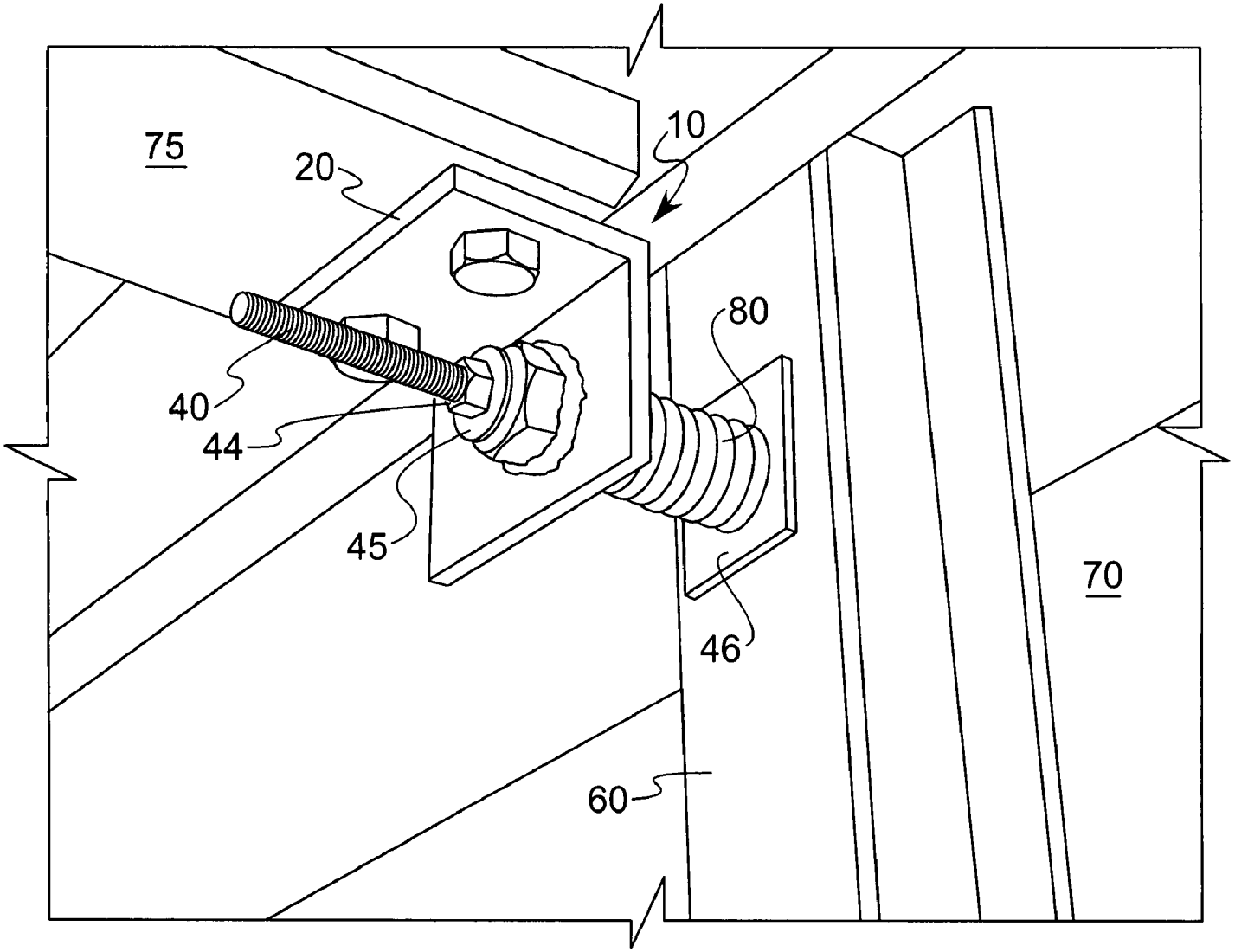
FIG. 1 is a view in perspective illustrating an embodiment of the present invention in an intermediate stage of construction.
Figure 2:
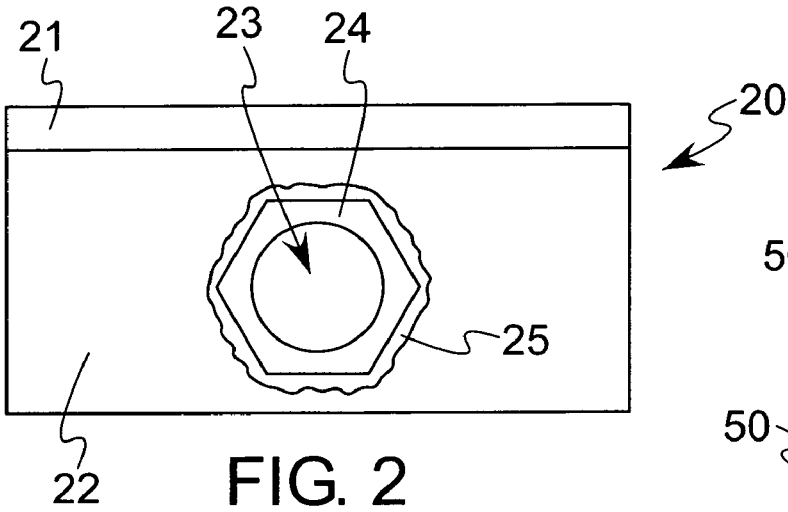
FIG. 2 is a top view illustrating a bracket that is preferably mounted at the upper end of a beam.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

The invention is shown assembled in FIG. 1 and in an operable position against the top end of a structural beam. The components of the invention are illustrated in FIGS. 2-5. The bracket 20 is an angled, preferably steel member having two legs 21 and 22. The leg 22 has a central aperture 23 around which a conventional threaded nut 24 is mounted to the leg 22, such as by weldment 25. The aperture extends entirely through the leg 22 for accommodating another member as described below. The leg 21 of the bracket 20 has a pair of apertures 26 and 27 formed therethrough for receiving members described below. The term "bracket" is defined herein to include any member that can mount to a building or be anchored in a structure around the building and support loads sufficient to reinforce a wall of that building that has been damaged as discussed herein.

Figure 4:
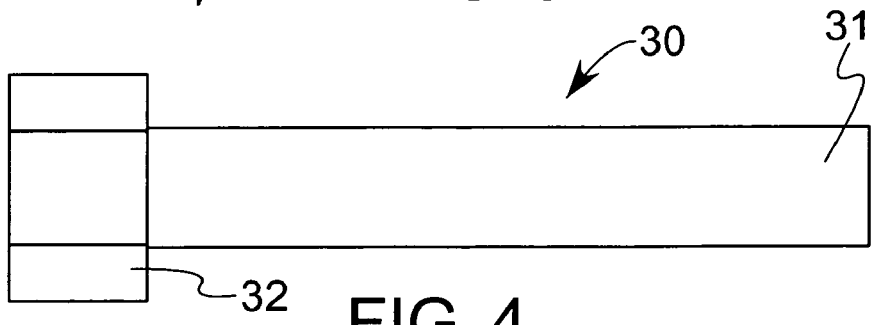
FIG. 4 is a side view illustrating a bolt that is preferably mounted in the bracket of FIGS. 2 and 3.
Figure 5:
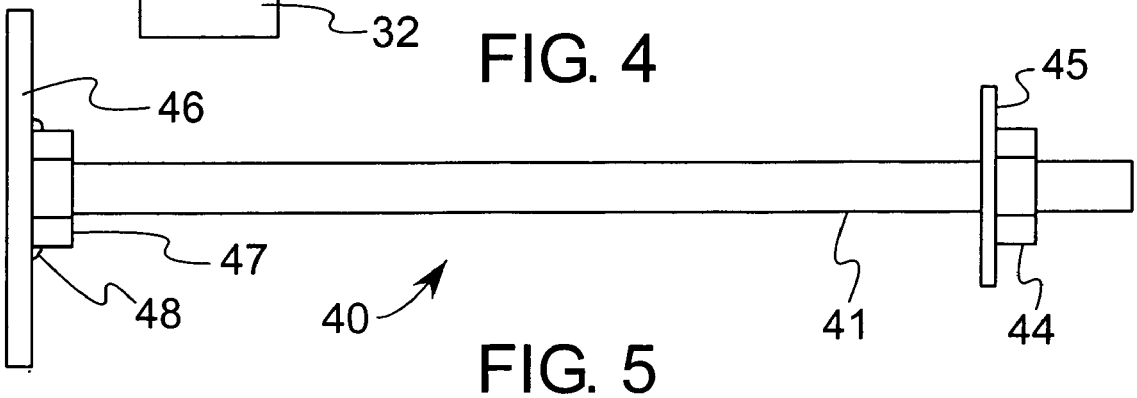
FIG. 5 is a side view illustrating a screw that is used to compress a spring.

The bolt 30, shown in FIG. 4, has a threaded shaft 31 and a multi-sided head 32. The threaded shaft 31 has an outer diameter that matches, or is slightly smaller than, the internal diameter of the aperture 23 of the nut 24 welded to the bracket 20. The head 32 is preferably a nut that is virtually identical to the nut 24, but which has been threaded onto the shaft 31 and welded thereto. Thus, the bolt 30 can be threaded into and through the nut 24 for reasons described below.

The screw 40 is a threaded shaft 41 upon which a threaded nut 44 is threaded. The washer 45 is conventional and slides onto the shaft 41 through an aperture slightly larger in diameter than the outer diameter of the shaft 41. The plate 46 is a planar steel plate that has a nut 47 mounted thereto, such as by weldment 48. Thus, the end of the shaft 41 can be threaded into the nut 47. However, because the plate 46 has no aperture formed through it, the shaft 41 will not extend through the plate 46.

Figure 6:
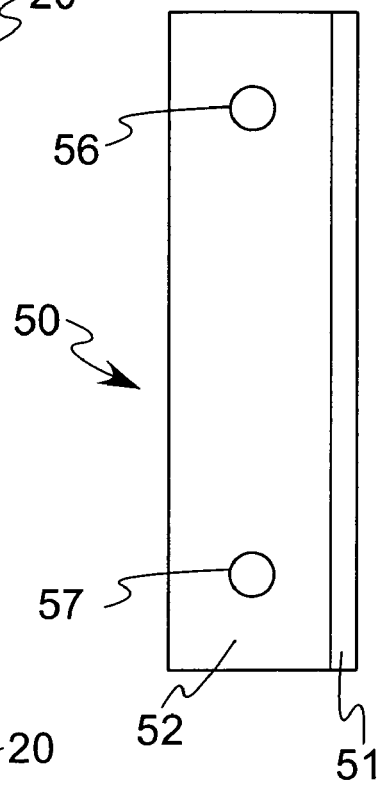
FIG. 6 is a top view illustrating a bracket preferably mounted at the lower end of a beam.

The bracket 50, illustrated in FIG. 6, is a steel angle member having two legs 51 and 52. The apertures 56 and 57 are formed in the leg 52 for reasons that will become apparent below.

Referring now to FIGS. 1 and 6, a structural member, such as the I-beam 60, is positioned vertically adjacent the wall 70. The wall 70 has sustained some form of lateral/horizontal damage, such as inward bowing, inward tilting or rotating, horizontal shear (multiple courses of blocks shifted inward relative to other courses) or it is anticipated that the wall will sustain such damage. It will be understood by the person having ordinary skill that the beam 60 could be substituted by any other structural support member, which is defined herein as a member that can resist a bending force applied to it. Substitutes include, but are not limited to, channels and tubes (square and other shapes) of any material, dimensional lumber (4×4, 4×6, etc.), composite beams, or any other structural support member.

Figure 7:
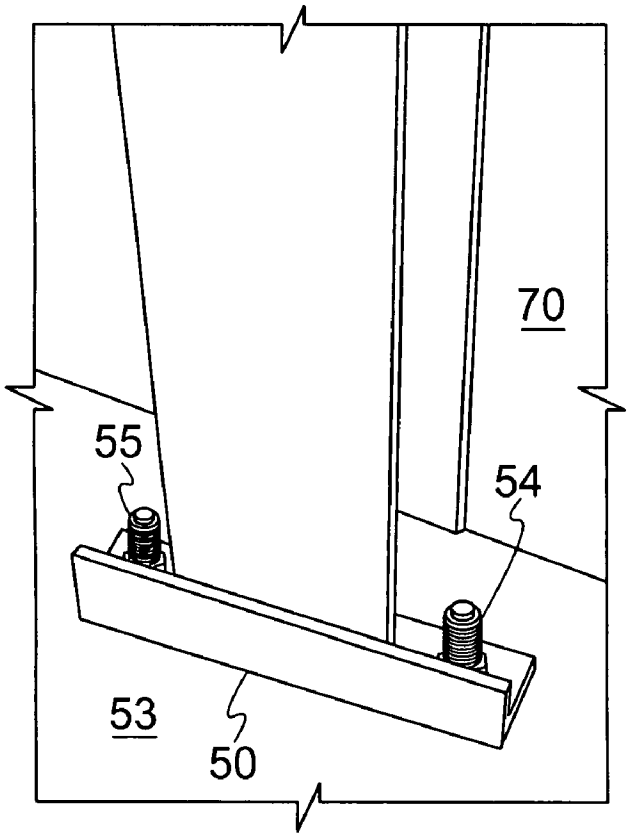
FIG. 7 is a view in perspective illustrating the bracket of FIG. 6 in an operable position.

As shown in FIG. 7, the lower end of the beam 60 is fixed at the region of the concrete floor 55 that abuts the wall 70 by the bracket 50. The bracket 50 is fixed to the floor by fasteners, such as bolts 54 and 55, extended through the apertures 56 and 57, respectively, and into apertures (not shown) formed in the floor 55, preferably by drilling. This is preferably accomplished by placing the beam against the wall, with the bottom end seating against the wall and the bracket 50 in the position it will be in when the beam is seated against the wall. The desired locations of the apertures that will be formed in the floor are marked by pencil through the apertures 56 and 57. The beam and bracket are then removed and the holes are drilled where marked. The bracket 50 is then placed in position and two anchor bolts are tightly forced into the apertures.

Once the bracket 50 is mounted in place, the beam is placed against the wall as shown in FIG. 7. The leg 51, when seated against the surface of the beam 60 that faces away from the wall 70, forms an upwardly extending lip that restricts movement of the lower end of the beam 60 away from the wall 70. Next, the floor joists (or other structure) to which the bracket 20 will be mounted are marked for bracket 20 positioning. This preferably occurs by first securing the upper end of the beam 60 with a brace to hold it from falling as described below. The bracket 20 is then placed against the joist in the finished position and the locations of holes are marked on the joists into which fasteners will be mounted.

Figure 3:
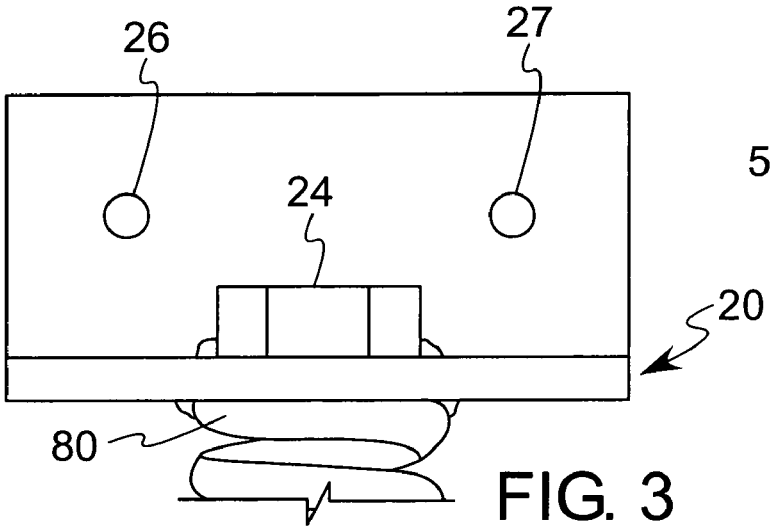
FIG. 3 is a side view illustrating the bracket of FIG. 2.

Before finding the final position of the bracket 20, however, a spring 80 must be pre-compressed to the length it will have when the bracket 20 is mounted in place. The spring 80 is a coil spring with, for example, a 1,000 lb. compression force, that can be attached to the plate 20 opposite the nut 24, such as by welding as shown in FIG. 3. The spring 80 is compressed using the screw 40 attached to the nut 47 welded to the plate 46. The plate 46 is mounted to one end of the shaft 41 and tightened onto the screw 40. The screw 40 extends through the central passage of the coil spring 80 and through the aperture 23 of the nut 24. The nut 44 and washer 45 are placed on the opposite end of the shaft 41 from the plate 46, and on the opposite side of the bracket 20 as the spring 80. The nut 44 is then tightened onto the shaft 41 until it seats against the nut 24. At this point, any further tightening of the nut 44 will begin to compress the spring 80 by virtue of the portion of the shaft 41 between the leg 21 and the plate 46 becoming shorter than the spring 80. The nut 44 is tightened until the distance between the surface of the plate facing away from the spring 80 and the surface of the leg 21 facing the spring is as small as desired. At this point, the spring 80 is fully compressed, or partially compressed if other than the full force of the spring is necessary or desired.

The bracket 20 is placed against the floor joist and the plate 46 is placed against the beam 60, the bracket mounting holes are marked with a pencil on the floor joist and the bracket 20 is taken away, thus leaving room for the drill bit that forms the holes into the floor joist. Once the holes are drilled, the bracket 20 is mounted in place by fasteners inserted through the bracket 20 with the plate 46 seated against the face of the beam 60 facing away from the wall 70 as shown in FIG. 1.

The bracket 20 is mounted to the floor joists seated on the wall 70 by a pair of conventional bolts extending through the apertures 26 and 27 into the floor joists or a supporting member 75 fixed thereto. The bracket 20 is fixed in place in such a way that it can support substantial forces exerted against it by the bolt 30 threaded through the nut 24 on the bracket 20, where the bolt 30 has an opposite end seating against the plate 46, which seats against the upper end of the beam 60. The bracket 20 also supports the spring 80 having opposite ends exerting forces against the bracket 20 and the plate 46, which seats against the upper end of the beam 60 as shown in FIG. 1. The manner in which the bracket 20 is mounted adjacent the wall may vary according to the circumstances encountered in any given situation, and may require modifications of the manner shown. However, a person having ordinary skill in the art will understand the necessary modifications, and therefore those are not explained herein.

After the bracket 20 is mounted as shown in FIG. 1, the screw 40 is removed by first unscrewing the nut 44 until the spring 80 releases slightly and exerts a force against the plate 46 and beam 60 (tending to push the beam toward the wall) and against the bracket 20 (tending to push the bracket away from the wall). Once the spring 80 unloads in this manner, the screw 40 is fully removed by unscrewing it from the nut 47 in the plate 46.

Figure 17:
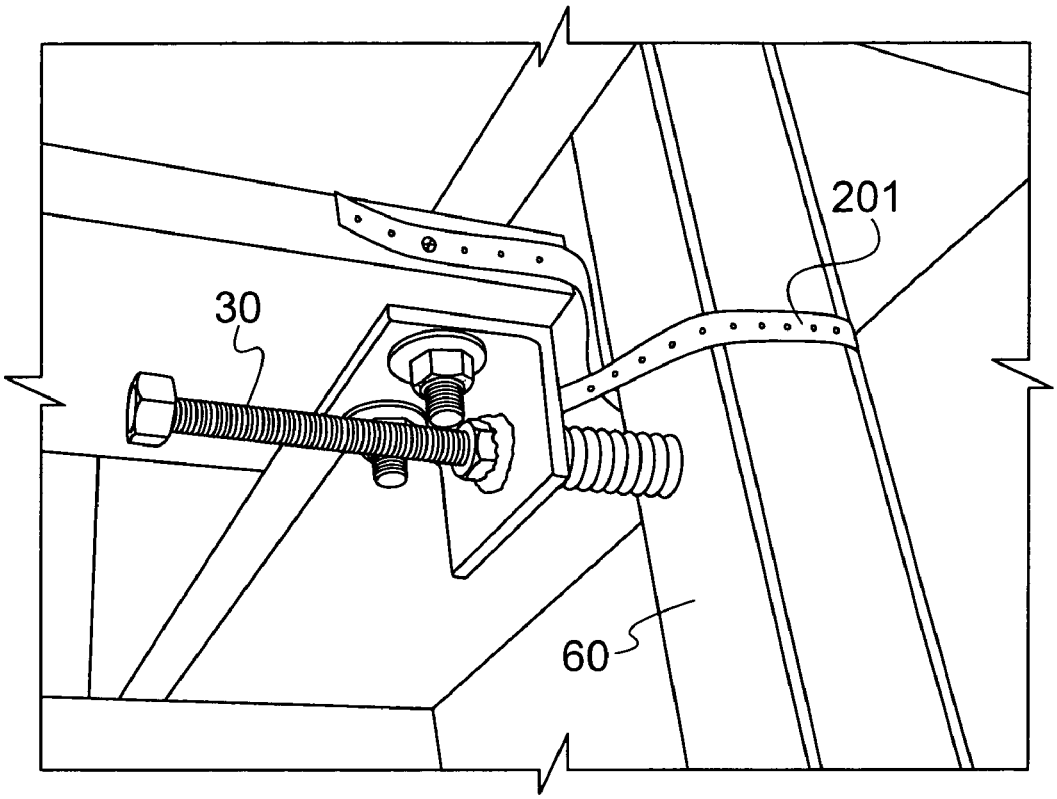
FIG. 17 is a view in perspective illustrating an embodiment of the present invention in an advanced stage of construction.
Figure 18:
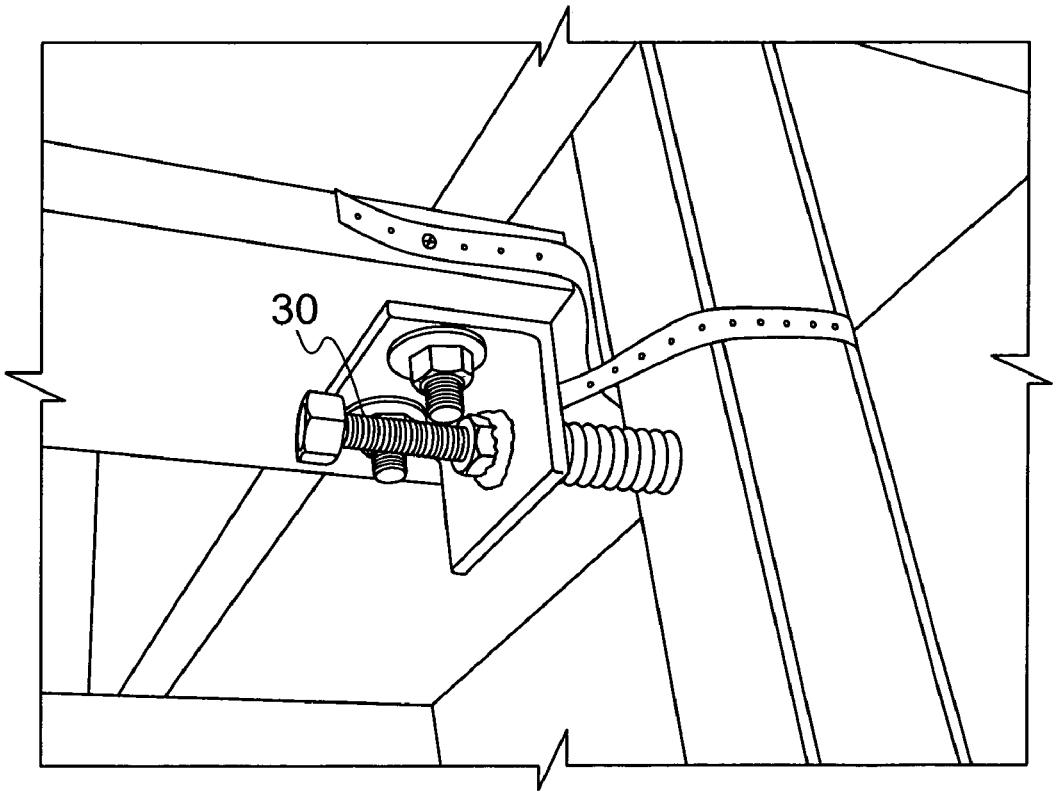
FIG. 18 is a view in perspective illustrating an embodiment of the present invention in a completed stage of construction.

Once the screw 40 is removed from the bracket 20, the bolt 30 (see FIG. 4) is threaded through the nut 24, extending inside the coiled spring 80 as shown in FIG. 17. The bolt 30 is rotated until its tip seats against the surface of the beam 60 that faces away from the wall 70, or seats against a structure interposed between the bolt and the beam, such as the plate 46. Upon further tightening of the bolt 30, the bolt tip will apply a force against the upper end of the beam 60 that increases as the bolt 30 is tightened further. The bolt 30 is then tightened to the desired force needed to straighten the wall 70, or at least begin straightening the wall. The bolt 30 is shown fully tightened in FIG. 18. Thus, the bolt 30 functions as a "force-applying device" to apply a horizontal force to the wall. There are other structures that can accomplish this function, such as a hydraulic ram, and it will be recognized by persons having ordinary skill that these other structures can be substituted for the bolt 30. The amount of force applied by the bolt 30 is dependent upon many factors known to the person of ordinary skill, including the time of year, whether the soil has been excavated away from the outside of the wall, the amount of torque applied as measured by a conventional torque wrench, etc.

In this configuration, the lower end of the beam 60 is seated against the bracket 50 and the wall 70 at its opposing faces. At the upper end, the beam 60 is typically spaced from the wall an amount determined by the bowing of the wall 70. The screw 30 exerts a significant outwardly-directed force against the beam, thereby tending to straighten the wall 70. The straightening effect may not be visible initially, but because a very strong force is applied at all times, the straightening effect becomes apparent over time.

Even when the soil outside the wall 70 begins to contract, whether due to reduction in moisture content, freezing and thawing or any other phenomenon, the apparatus 10 will still apply a force to the beam 60. This force is applied even if the bowing or other lateral damage in the wall 70 is reduced, because of the constant force applied by the spring 80, even if the screw 30 loses contact with the beam 60. Where conventional wall reinforcing devices apply a force when the wall is bowed a particular amount and stop applying the force when the bowing is reduced, the invention applies a force at all times, regardless of the reduction in bowing of the wall. This constant force not only prevents the beam 60 from falling over, but continues to straighten the wall as the soil contracts.

The device shown in the illustrations above is one means for applying this constant force to the beam. The person having ordinary skill in the art will understand that other devices can be substituted for the embodiment shown to accomplish the same purpose, which is to apply a constant force to the beam regardless of displacement of the beam away from the device. For example, the coil spring 80 described above could be replaced by any other device that can apply a constant force to the wall, regardless of the displacement of the wall. An example of another device is an elastomeric spring, such as a block of rubber or other elastomeric material. A device that applies a constant force to the beam and/or the wall regardless of displacement of the beam or wall away from the device is defined herein as a "bias". Other biases include gas or pneumatic springs, leaf springs and magnetic springs. This list is not intended to be exhaustive, but illustrative, of the kinds of biases that could replace the coil spring 80.

The invention includes a bias that exerts a force against the bracket 20 and an opposing force against the beam, even if the beam moves several inches, a foot or even more. Typically, however, the distance will be on the order or several inches or less. A bias, for the purposes of the present invention, must exert a force if the beam is displaced toward the wall (away from the bracket 20) about one-sixteenth of an inch or more, such as by the wall "relaxing." Any force applied only through less than one-sixteenth of an inch is not considered a bias for the purposes of the invention. It will become apparent that the term "bias" does not include structures, such as the force-applying device of the Heady et al. patent, which exert a force upon the beam, but when the beam is displaced a small distance away from it, the force is completely released. This is due to the fact that the force-applying device of Heady et al. is not a spring that exerts a force, when compressed, through the entire range of its compression.

Figure 15:
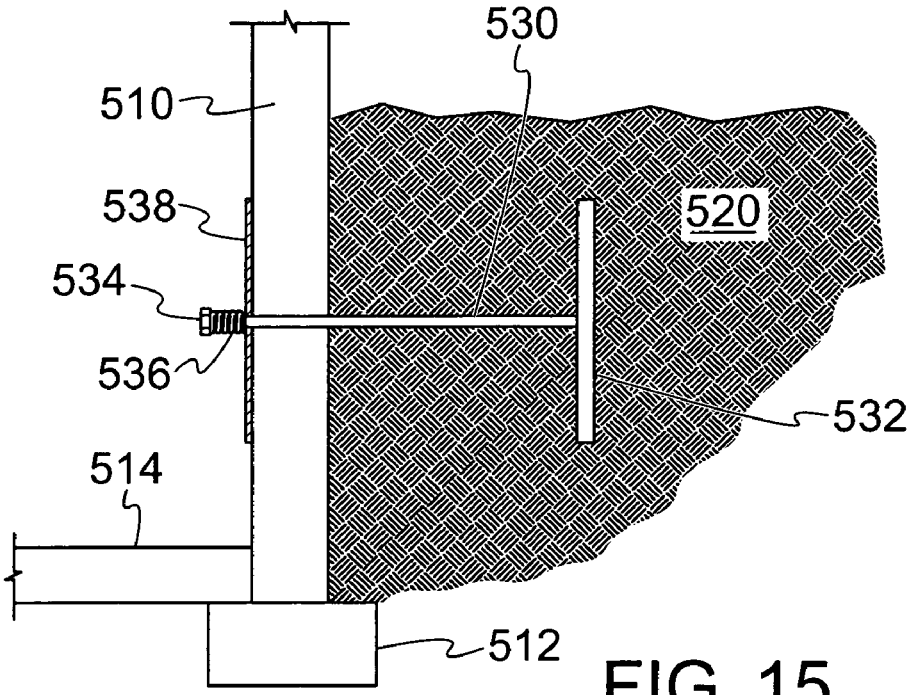
FIG. 15 is a side schematic view illustrating an alternative embodiment of the present invention.

FIG. 15 shows an alternative embodiment of the invention in which a wall 510 is mounted on a footing 512 and a floor 514 is formed thereon. Backfill, such as soil 520, is disposed against the outer surface of the wall 510. A rod 530 extends from the soil 520, where it is attached to a bracket, such as the vertical plate 532, through the wall 510 and to the inner surface of the wall. The rod 530, which serves as an extension of the bracket, has a threaded end or other fastening means to which a nut 534 is mounted. A spring 536 surrounds the inner end of the rod 530, and is compressed between a structural support member, such as the plate 538 seated against the wall 510, and the nut 534, thereby exerting a constant force on the wall, tending to force the wall toward the soil 520. In this embodiment, the bracket (plate 532) is anchored in the soil and the structural support member (plate 538) extends along the interior of the wall, but need not be fastened at the top or the bottom ends. The plate 538 could be substituted by a beam or a pair of C-channels fastened together with a rod extending through the middle thereof. It is contemplated that the rod 530 can attach to any holding device in the soil, including a helical disk, dead-man anchor or any other structure that supports the inward force on the rod by the wall. Additionally, concrete can be formed around the plate 532 to further support the plate 532.

Figure 8:
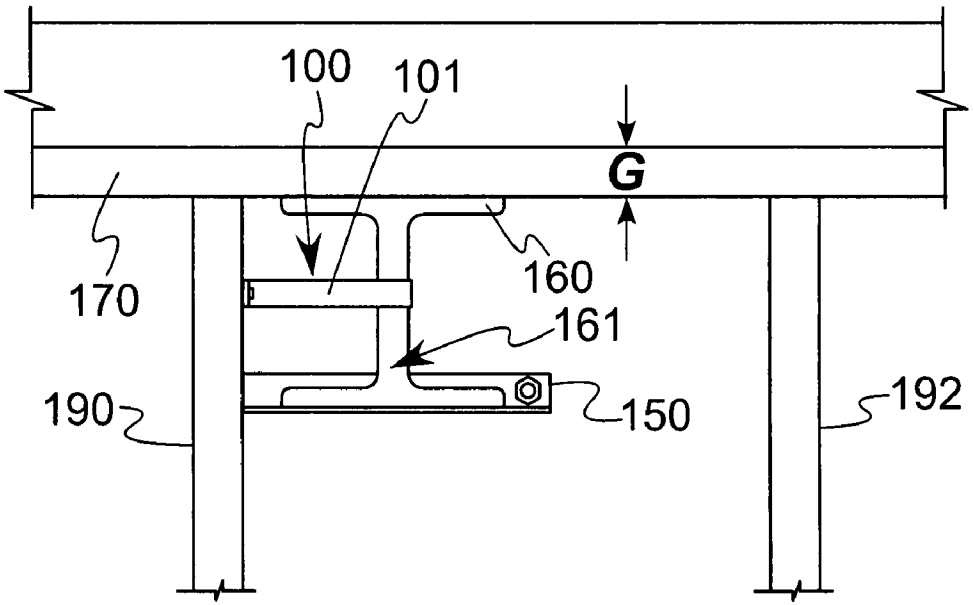
FIG. 8 is a top view illustrating a brace in an operable position for holding the beam from falling laterally.

It is contemplated, as an alternative, that a device can be used in combination with the beam, bracket and force-applying device system that does not exert a constant force against the beam in the direction of the wall, but simply holds the beam in place so that it does not fall over. One example of such a structure is shown in FIG. 8, in which the wall 170 is bowed (see the gap, G) and the beam 160 is fixed at the floor by the bracket 150. The support at the upper end is not shown, but can be a bracket like the bracket 20 fixed to the floor joists 190 and 192. A bolt similar to the bolt 30 extends through the bracket and is tightened against the beam 160. Thus, a force is applied to the beam 160 that tends to straighten the wall 170, but that force is not supplemented by a constant spring force (bias).

Figure 9:
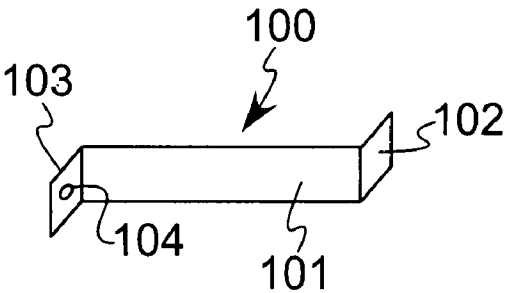
FIG. 9 is a view in perspective illustrating an alternative embodiment of the brace.

Because the beam 160 does not have a bias, it would be able to fall if the inwardly directed force on the wall 170 by the soil relaxed sufficiently. However, the clip 100 is mounted to the joist 190. The clip is shown in greater detail in FIG. 9, in which it is shown having a body 101, first leg 102 and second leg 103. An aperture formed through the second leg 103 accepts a screw that can be screwed into a floor joist, the sill plate, etc. of the structure (see FIG. 8). The body 101 extends over the web of the beam 160 and the first leg 102 extends over the distal face of the web 161. Thus, if the force applied to the beam 160 dissipates, or the wall 170 pulls away from the beam 160, the beam 160 will not move laterally, because the clip holds the beam in place.

There are many alternative devices for holding structural members in place in the same manner as the clip 100. All such structures contemplated according to the invention form a channel into which the structural member that supports the bowed wall is inserted. Such channels can be formed using additional structures to those used conventionally. Alternatively, such channels can be formed using additional structures and existing structures.

Figure 10:
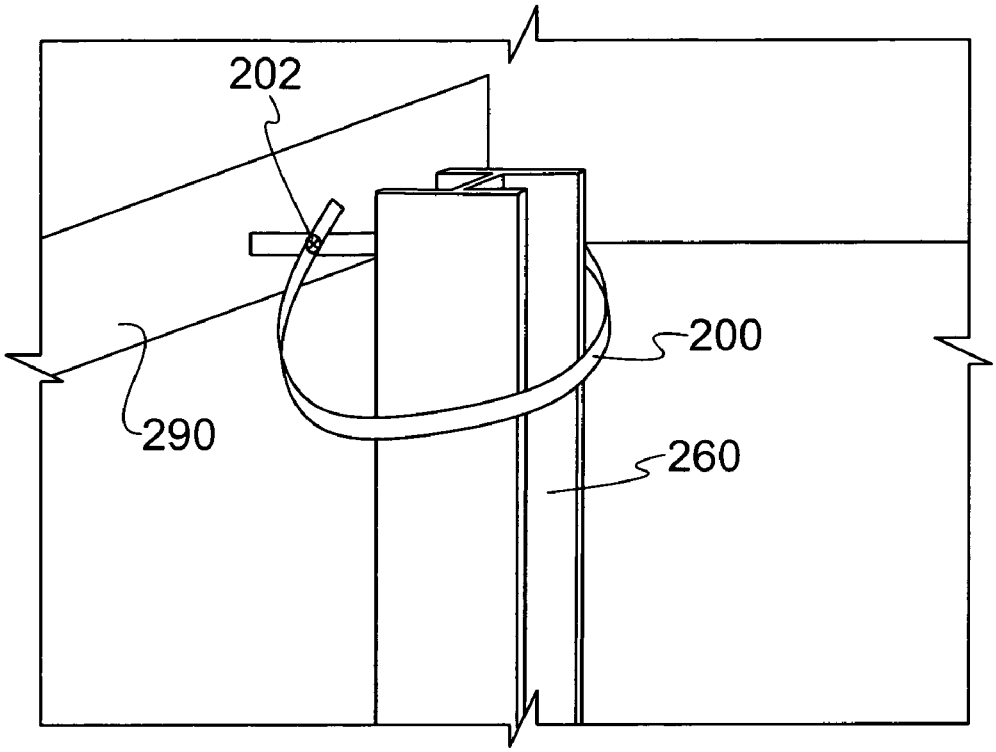
FIG. 10 is a view in perspective illustrating an alternative embodiment of the brace.

Some examples of alternative devices include straps, ropes, chains or any other member that extends entirely in a loop around the top end of the structural member that reinforces the wall and attaches to a component of the building in which the beam is being installed. Such components include the floor at the base of the beam, the floor above the beam, the wall itself, or any joists or supporting structure for the floor above the beam. For example, the strap 200 in FIG. 10 extends around the beam 260 and attaches using a screw 202 to the joist 290. The strap 201 in FIG. 17 likewise holds the beam 60.

Figure 11:
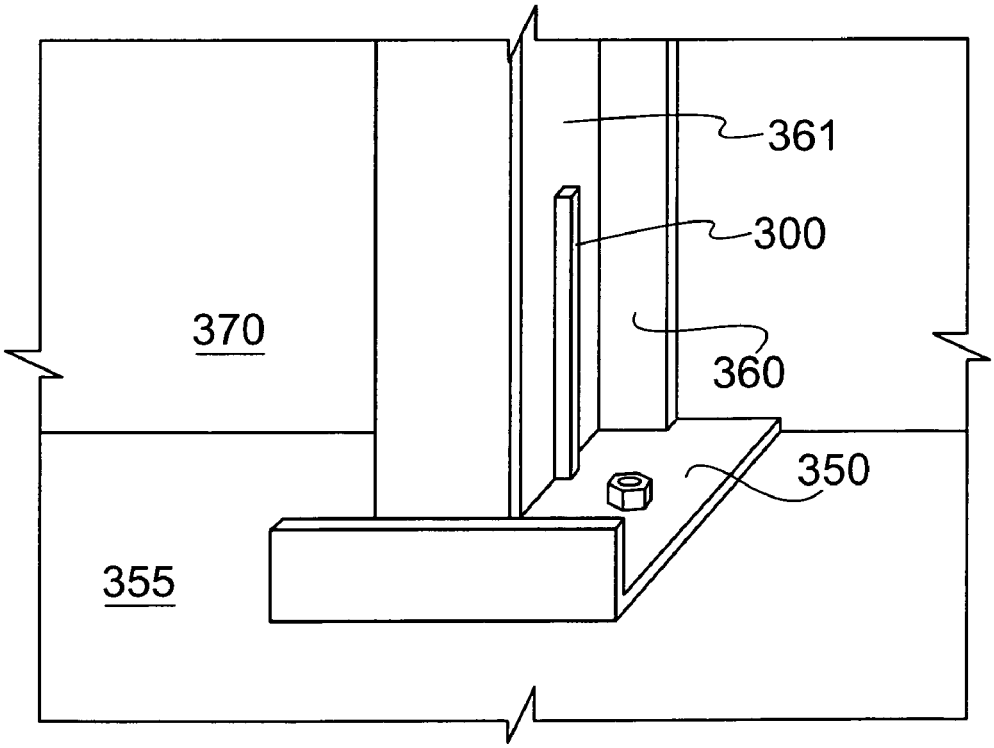
FIG. 11 is a view in perspective illustrating an alternative embodiment of the brace.

Another alternative manner of forming a channel around the structural member is a floor plate that has members extending upwardly to support the beam from moving laterally. An example of this is shown in FIG. 11, in which a beam 360 seats against a wall 370. A bracket 350 mounts to the floor 355, and a support member 300 extends rigidly upwardly from the bracket 350 on one side of the beam 360, and another support member (not shown) extends rigidly upwardly form the bracket 350 on the opposite side of the beam's flange 361. The support members prevent the beam 360 from tilting to one side or the other by creating a channel between them into which the flange is inserted.

Figure 12:
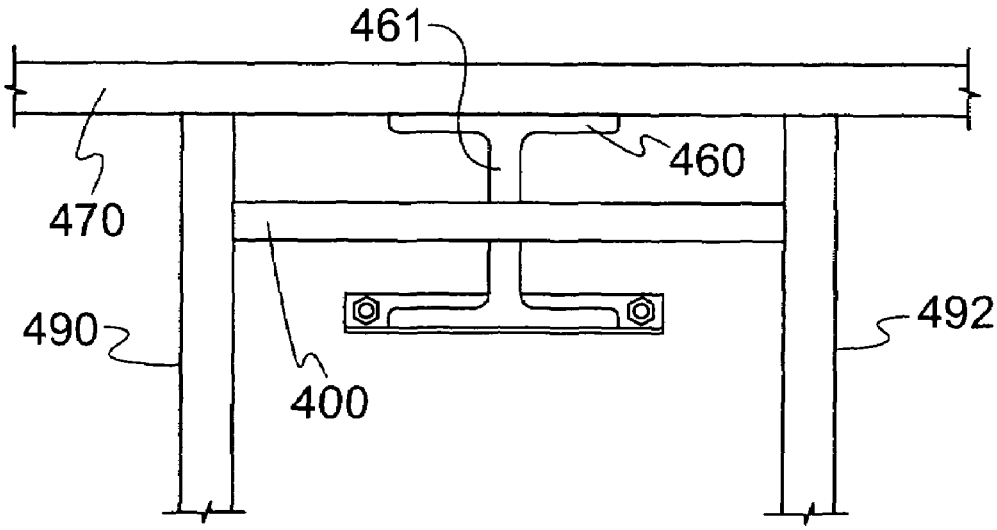
FIG. 12 is a view in perspective illustrating an alternative embodiment of the brace.
Figure 13:
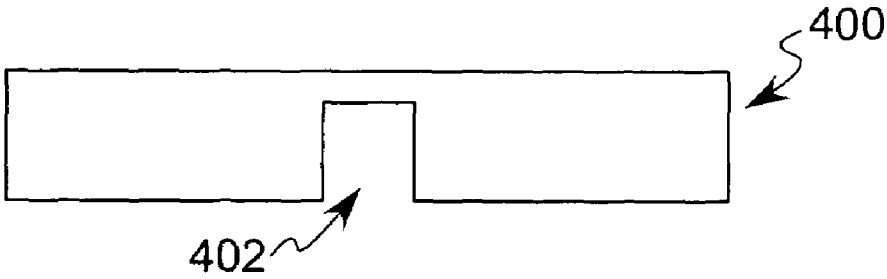
FIG. 13 is a view in perspective illustrating an alternative embodiment of the brace.
Figure 14:
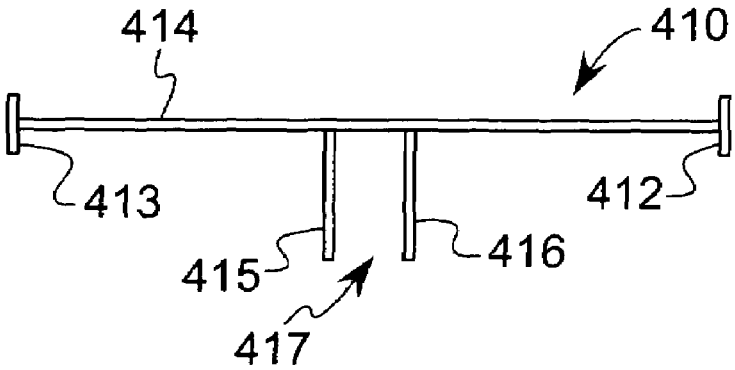
FIG. 14 is a view in perspective illustrating an alternative embodiment of the brace.

Yet another example of a channel around the structural member is shown in FIG. 12, in which a beam 460 is mounted against a wall 470 between a pair of floor joists 490 and 492. The member 400 extends between the floor joists 490 and 492 and fastens thereto. The member forms a channel into which the flange 461 is inserted. The member 400 is a two by four board shown in FIG. 13 that mounts to the joists 490 and 492, such as by nails inserted through the joists and into the adjacent ends of the member 400. The flange 461 was inserted into the channel 402 formed in the member 400. An alternative to the member 400 is the member 410 shown in FIG. 14. The member 410 has tabs 412 and 413 through which nails can be driven into the joists 490 and 492. The body 414 has two downwardly extending legs 415 and 416 that form a channel 417 therebetween. Thus, the flange 461 of the beam 460 can be inserted into the channel 417 and maintained against lateral movement.

Figure 16:
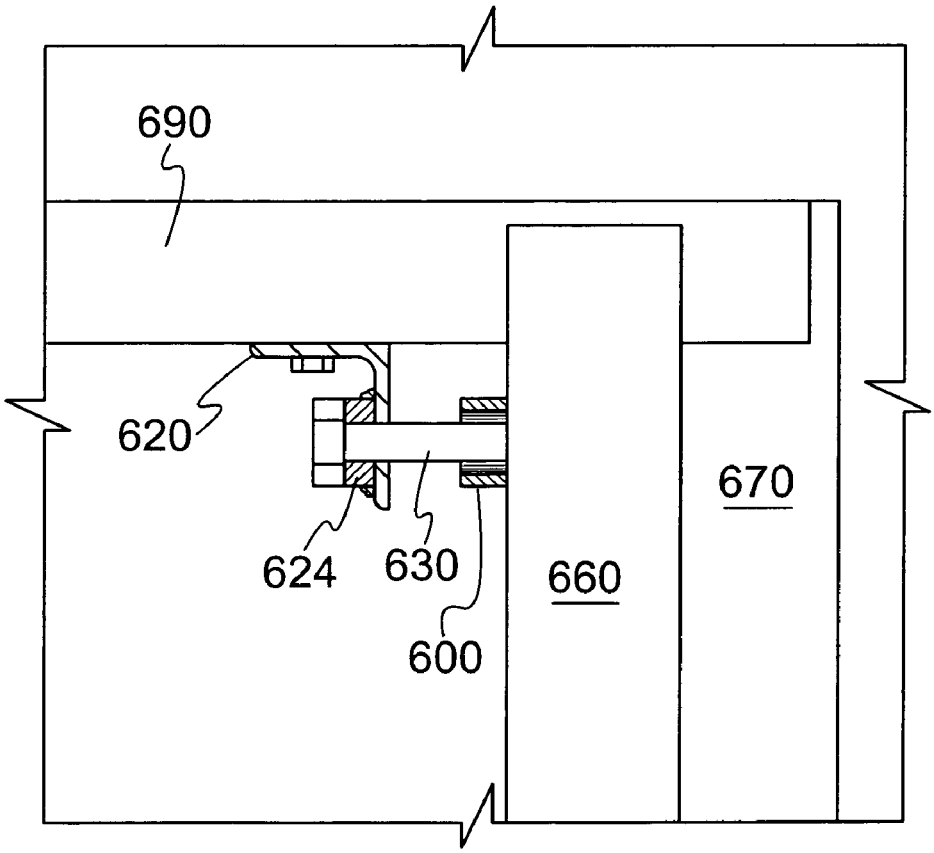
FIG. 16 is a side schematic view illustrating an alternative embodiment of the invention.

Another means for keeping a support beam upright if the wall "relaxes" and pulls away from the beam is shown in FIG. 16. The beam 660 is forced against the wall 670 by the bolt 630 extending through the nut 624 welded to the bracket 620. The bracket 620 is mounted to the floor joist 690 in a similar manner to the bracket 20 described above. A holding ring 600 is mounted to the beam 660 and the bolt 630 is inserted therein to seat against the beam 660. The holding ring 600 is preferably an annulus mounted rigidly to the beam at one end, and having an inner diameter at least slightly greater than the outer diameter of the bolt 630. The holding ring can be made of any material that has sufficient strength, including metal, composite or plastic, and is mounted to the beam with means, such as welding, adhering, or forming integral with the beam, strong enough to resist fracture under the lateral weight of the beam. Thus, if the wall 670 pulls away from the beam 660, the beam will not fall over, because the inner surface of the holding ring 600 rests against the side of the bolt 630. Only if the beam moved away from the bolt 630 farther than the length of the holding ring 600, which can be in the range of a fraction of an inch to several inches long, would the beam lose its lateral support. In addition to being mounted to the beam 660, the holding ring 600 can be threaded onto, or otherwise attached to, the bolt 630, in order to prevent any movement of the beam relative to the bolt 630.

Figure 19:
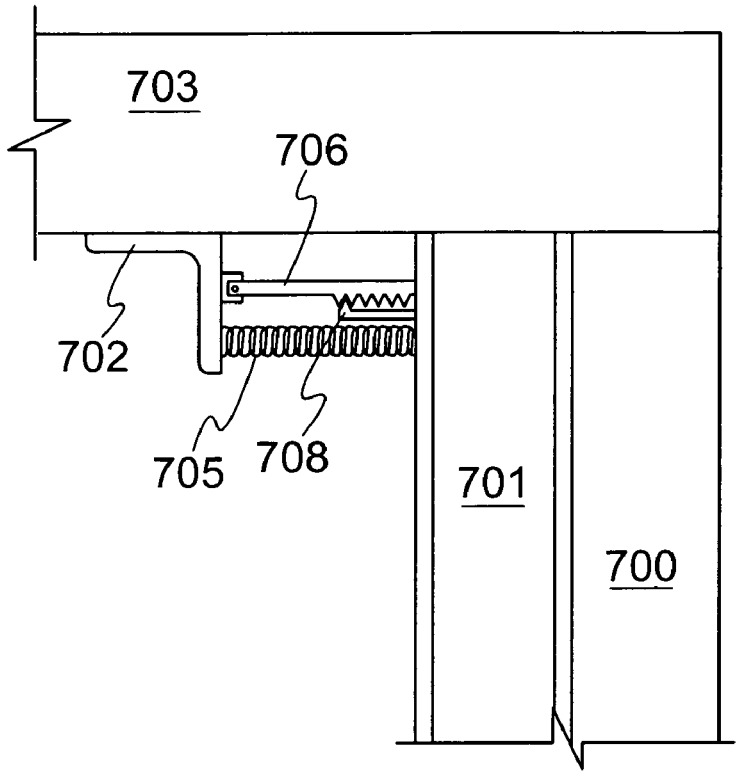
FIG. 19 is a schematic side view illustrating an alternative embodiment of the invention.

Still another means for applying a continuous force to a structural member is shown in FIG. 19. A wall 700 has a beam 701 seating against it for support, and a bracket 702 is mounted to the floor joist 703. A coil spring 705 is interposed between the bracket and the beam 701, and applies opposing forces to the bracket and the beam. A sawtooth member 706 is pivotably mounted to the bracket 702, and has teeth along its underside that engage the pawl 708, which extends from rigid attachment to the beam. As the wall relaxes, the spring 705 pushes the beam 701 to the right in FIG. 19, which then permits the sawtooth member 706 to pivot upwardly, as the angled pawl 708 moves with the beam, and drop downwardly under the force of gravity or a spring (not shown) to engage the pawl in a different notch between two teeth. This embodiment permits the beam to move away from the bracket 702 when the wall relaxes, but does not permit the beam to move back toward the bracket when the wall begins to move inwardly due to changes in the horizontal forces of the soil.

Thus, the embodiment of the invention shown in FIG. 19 has the added feature of a "ratchet" means that does more than apply a continuous force to the beam all year. The ratchet means keeps the pressure on the beam, and limits the displacement of the beam returning back toward the bracket and the beam's original position after the "relaxing" of the wall has ended. Thus, rather than a worker having to return periodically and manually check the tightness of the force-applying device on the beam, the apparatus shown in FIG. 19 automatically adjusts the tightness of the force-applying device.

Figure 20:
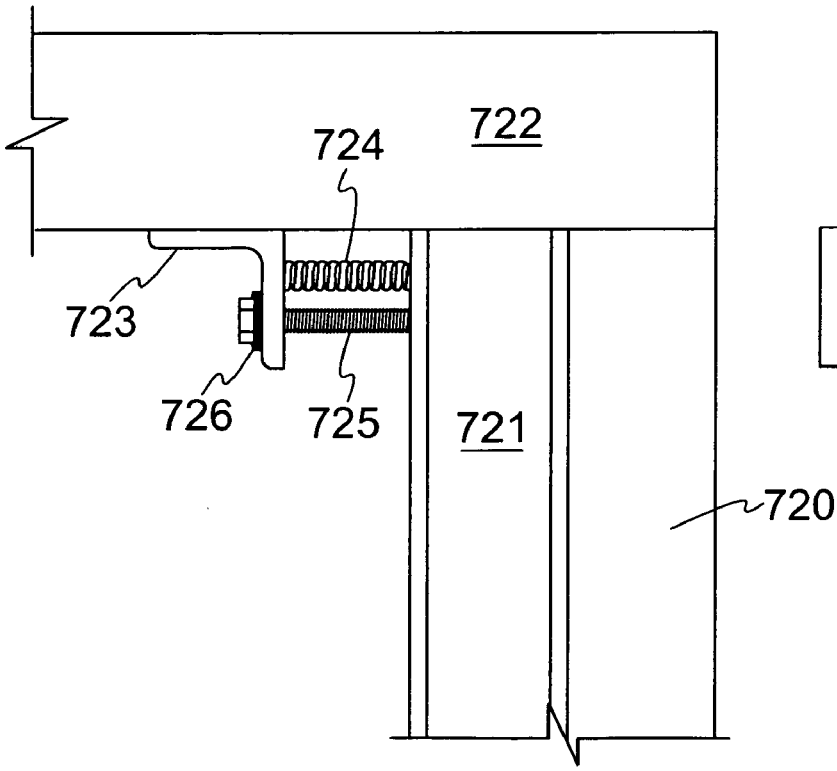
FIG. 20 is a schematic side view illustrating an alternative embodiment of the invention.
Figure 21:
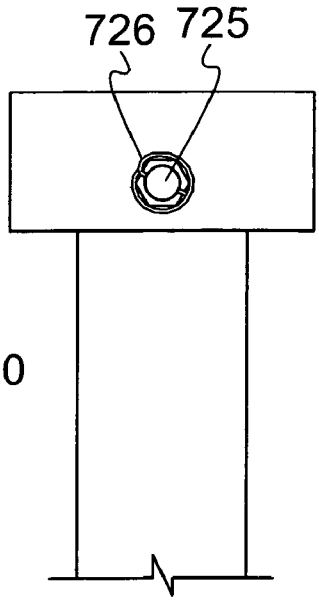
FIG. 21 is a schematic front view illustrating the embodiment of FIG. 20.

There are many alternative embodiments of this ratchet means, one of which is shown in FIG. 20 to include the wall 720 with the beam 721 and the bracket 723 mounted to the joist 722. The spring 724 serves as the bias, and the bolt 725 is the force-applying device. A torsion spring 726 mounts to the head of the bolt 725, and is torsionally-loaded and mounted to the bracket 723. If the force on the tip of the bolt 725 drops below a predetermined amount, the torsion spring 726 rotates the bolt 725, thereby tightening the bolt 725 and eliminating any gap formed by the beam separating from the tip of the bolt 725.

Figure 22:
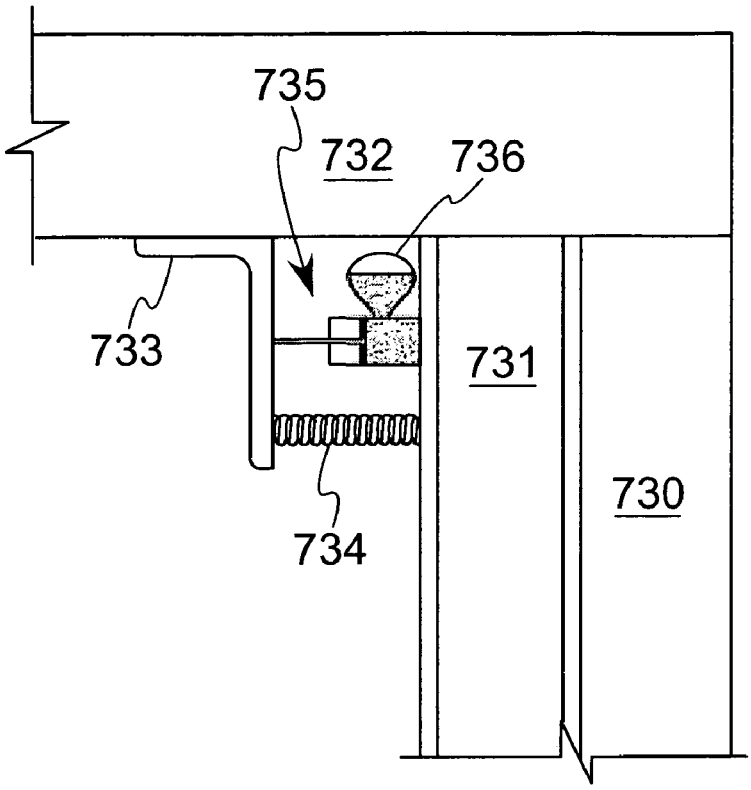
FIG. 22 is a schematic side view illustrating another alternative embodiment of the invention.

In another alternative shown in FIG. 22, a beam 731 seats against a wall 730 and a bracket 733 is mounted to a floor joist 732. A spring 734 serves as the bias, and the cylinder/piston combination 735 attaches at opposite ends to the bracket and the beam. If the spring 734 moves the beam 731 away from the bracket 733, the volume of the cylinder increases and a void forms into which sand or some other incompressible particulate pours from the supply tank 736 into the void. Because the sand cannot be forced upwardly out of the cylinder, this structure serves as a ratchet means to limit movement of the beam and wall back toward the bracket.

Figure 23:
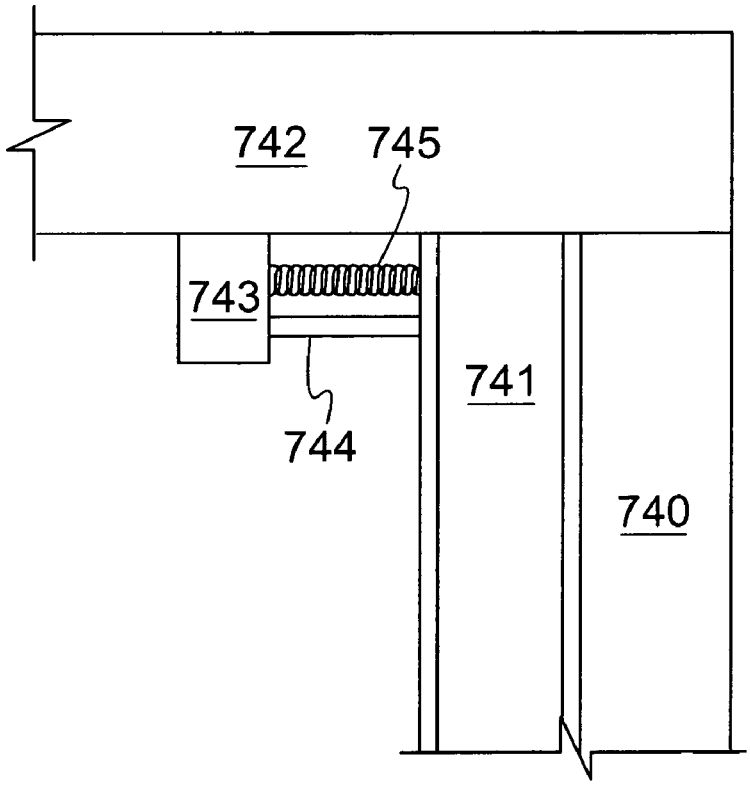
FIG. 23 is a schematic side view illustrating another alternative embodiment of the invention.
Figure 24:
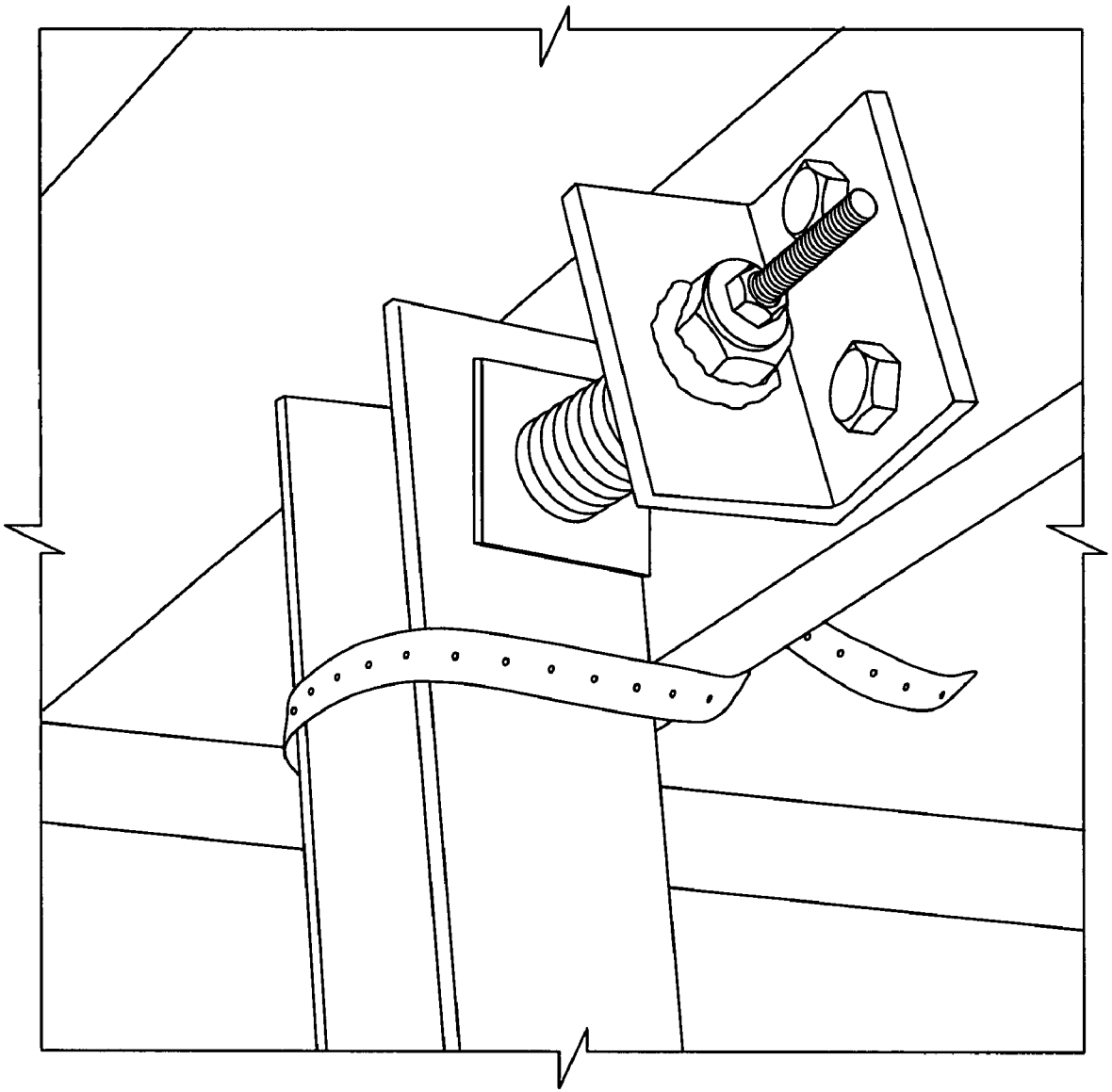
FIG. 24 is a view in perspective illustrating an alternative attachment to the building in which the invention is mounted.

As a final example, but not as a limit to the possible alternatives, the embodiment shown in FIG. 23 includes a beam 741 mounted against a wall 740 and an adjustable force-applying device 743 is mounted to the joist 742. If the pressure on the shaft 744 decreases below a predetermined minimum, which could be determined by a load cell (not shown) in the device 743, the device 743 automatically applies a force to the shaft 744 to apply a force to the beam 741, or take up any gap that may have formed between the tip of the shaft 744 and the beam 741. The spring 745 serves as the bias. Thus, the device 743 could include any prime mover and feedback mechanism that senses the force on the shaft 744, and adjusts the position of the shaft 744 when the force reaches a predetermined minimum.

While certain preferred embodiments of the present invention have been disclosed in detail, it is to be understood that various modifications may be adopted without departing from the spirit of the invention or scope of the following claims.

The invention claimed is:

1. An apparatus supporting a wall in a building with a structural member seated against the wall, the structural member having a lower end mounted at a floor that intersects the wall and the member extending upwardly away from the floor to an upper end, the apparatus comprising:

(a) a bracket mounted to the building and spaced from the upper end of the structural member;

(b) a bolt extending through and threadedly engaging an aperture of the bracket and having one end seating against the structural member wherein the bolt is adjustably and longitudinally movable relative to the bracket by rotating the bolt about its axis;

(c) a spring extending between the bracket and the structural member- and exerting oppositely-directed forces against the bracket and the structural member, one of said forces having a component directed toward the wall.

2. The apparatus in accordance with claim 1, wherein the spring is a coil spring extending from the bracket to the structural member and encircling at least a portion of the bolt extending from the bracket to the structural member.

* * * * *